US010840590B1

(12) United States Patent
Wolf et al.

(10) Patent No.: US 10,840,590 B1
(45) Date of Patent: Nov. 17, 2020

(54) ENCLOSURE WITH INTEGRATED LIFTING MECHANISM FOR ANTENNAS

(71) Applicant: Amphenol Antenna Solutions, Inc., Rockford, IL (US)

(72) Inventors: Griffin M. Wolf, Hickory, NC (US); Charles E. Gaither, Conover, NC (US); Thomas F. Aberasturi, Charlotte, NC (US); Aaron M. Joyce, Denver, NC (US)

(73) Assignee: Amphenol Antenna Solutions, Inc., Rockford, IL (US)

( * ) Notice: Subject to any disclaimer, the term of this patent is extended or adjusted under 35 U.S.C. 154(b) by 0 days.

(21) Appl. No.: 16/852,224

(22) Filed: Apr. 17, 2020

Related U.S. Application Data

(60) Provisional application No. 62/902,206, filed on Sep. 18, 2019.

(51) Int. Cl.
*H01Q 1/42* (2006.01)

(52) U.S. Cl.
CPC ..... *H01Q 1/42* (2013.01)

(58) Field of Classification Search
CPC ..... H01Q 1/42; H01Q 1/04
See application file for complete search history.

(56) References Cited

U.S. PATENT DOCUMENTS 9,385,423 B2 * 7/2016 Boutigny ..... H01Q 1/42

* cited by examiner

*Primary Examiner* — Hoang V Nguyen
(74) *Attorney, Agent, or Firm* — Blank Rome LLP

(57) ABSTRACT

An antenna assembly has a main body configured to receive an antenna, and an uninterrupted top cap attached to the main body. The uninterrupted top cap has an outer surface. A lifting assembly is attached to at the outer surface of said top cap without penetrating the cap. Accordingly, the uninterrupted cap forms an unbroken whole. The uninterrupted cap is continuous without any through-holes or other perturbances or features that extend through the cap or otherwise might allow fluid to pass through the cap into an interior of the main body.

23 Claims, 9 Drawing Sheets

FIG. 1 - PRIOR ART
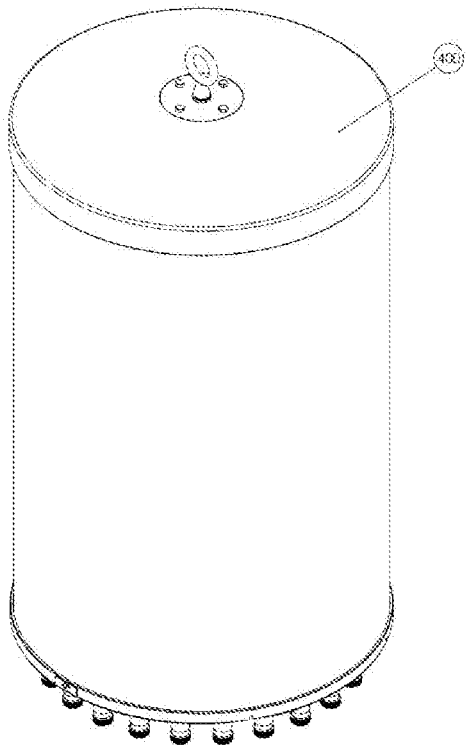
FIG. 2 – PRIOR ART
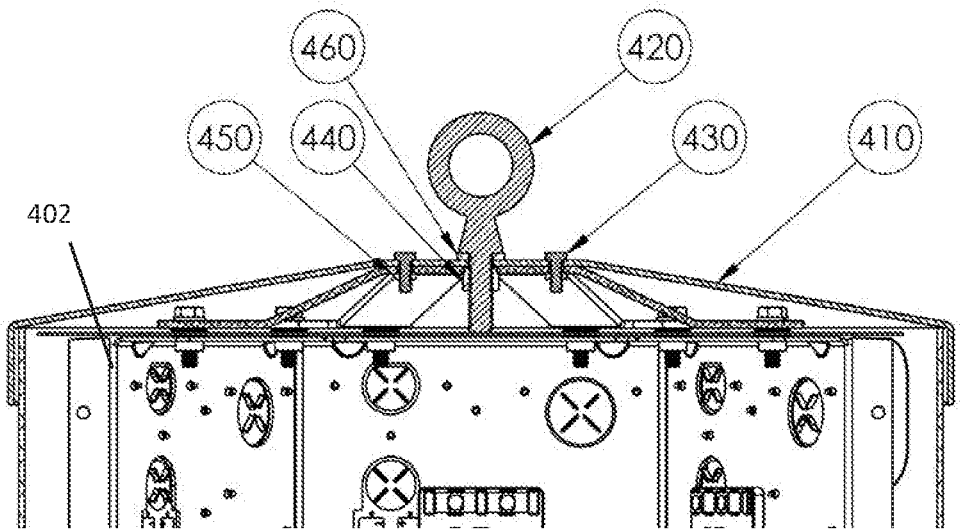

FIG. 3 – PRIOR ART
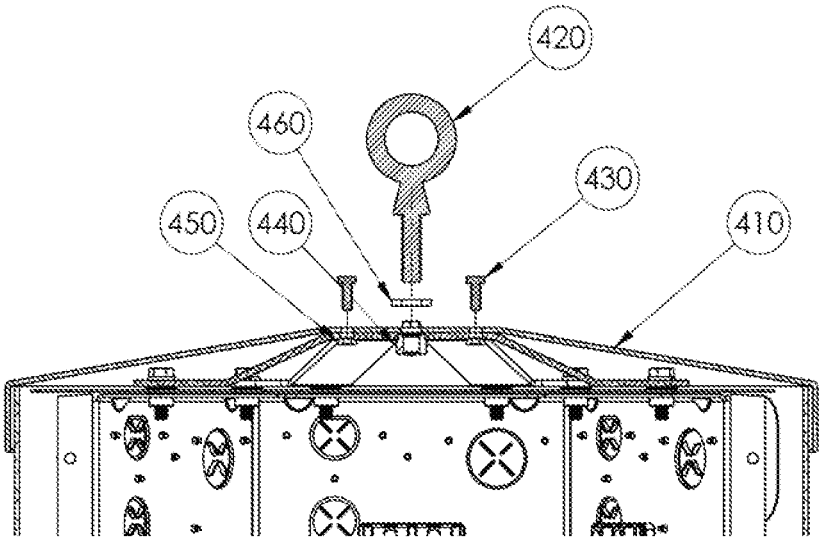
FIG. 4
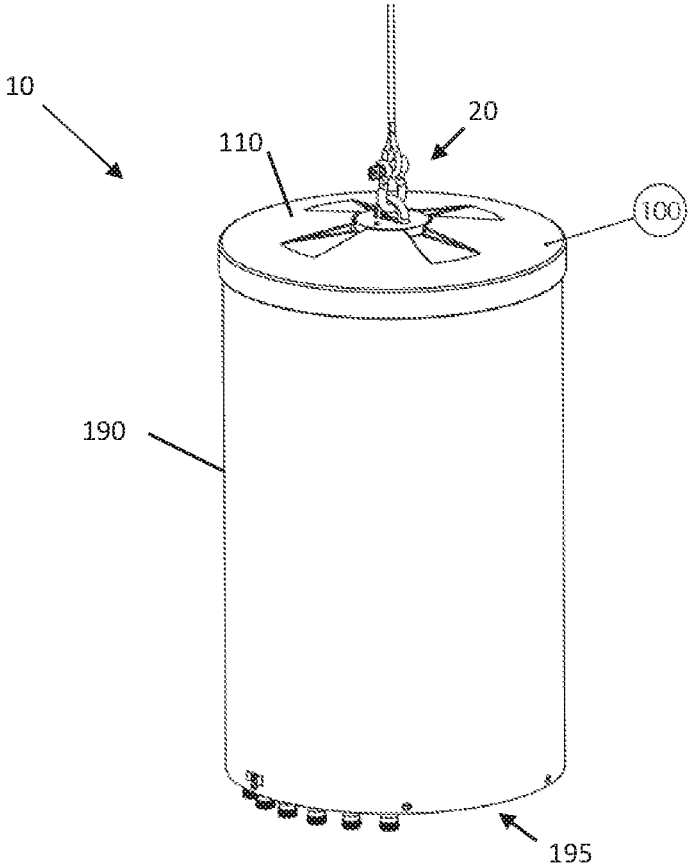

ENCLOSURE WITH INTEGRATED LIFTING MECHANISM FOR ANTENNAS

CROSS-REFERENCE TO RELATED APPLICATION

This application claims the benefit of priority of U.S. Provisional Application No. 62/902,206, filed on Sep. 18, 2019, and entitled Integrated Lifting Mechanism for Canister Antennas, the content of which is relied upon and incorporated herein by reference in its entirety.

BACKGROUND

In the wireless communication industry, growing demand for antenna (small cell) deployments due to 5G densification requirements necessitates an efficient and aesthetic means of installation. Due to these 5G requirements, the complexity and weight of antennas is increasing and may require operator assisted installation. This growth in complexity and weight will continue in order to meet current and future generation requirements. While complexity continues to grow, application objectives and zoning regulations dictate that every effort is made to minimize the volumetric footprint of the installed antenna, plurality of antennas, and enclosures, shrouds.

Current state-of-the-art deployments include various lifting mechanisms that require penetration through the enclosure and create environmental ingress points.

FIGS. 1-3 show an example of the current state of the art. FIG. 1 shows a fully assembled antenna enclosure 400 with a non-integrated lifting mechanism for a common multi-node small cell antenna 402. FIG. 2 shows a sectional view of the current state of the art in FIG. 1. The antenna 400 has a molded top cap 410 and threaded eyelet-like feature 420 that passes completely through the top cap 410, and threads into the captive nut 440 which is installed in the lifting bracket 450. A water-tight fit is formed between the eyelet-like feature 420 and the top cap 410 with a sealing washer 460. The lifting bracket 450 is fastened to the top cap 410 with four screws 430 that thread into the captive nuts 450 which are installed in the lifting bracket 450.

FIG. 3 shows a sectional view of the current state of the art of FIGS. 1, 2, with the eyelet 420 and screws 430 removed to show the thru holes in the cap 410. The thru holes fully penetrate the enclosure and threadably receive the eyelet 420 and screws 430. However, even with the screws 430 and eyelet 420 properly installed, water ingress into the enclosure becomes an issue over time, which can potentially lead to interference and failures. One such example of the prior art of FIGS. 1-3, is the antenna made by KP Performance, Proline Sector Antennas, and the antenna made by Alpha Wireless, Model No.

No admission is made that any reference or information cited herein constitutes prior art. Applicant expressly reserves the right to challenge the accuracy and pertinence of any cited documents.

SUMMARY

An aspect of this disclosure is an antenna assembly having a radome configured to receive an antenna, an uninterrupted cap attached to said radome, said uninterrupted cap having an outer surface, and a lifting assembly attached at the outer surface of said cap. In certain examples, the uninterrupted cap forms an unbroken whole. In certain examples, the uninterrupted cap is continuous without any through-holes or other perturbances or features that extend through the cap or otherwise might allow fluid to pass through the cap into an interior of the main body. In certain examples, the lifting assembly includes a ring or coupling feature integrally formed with the uninterrupted cap. In certain examples, the lifting assembly includes a ring or coupling feature removably attached to said uninterrupted cap. In certain examples, a pin or pins ar coupled to or embedded partway through the uninterrupted cap, said lifting assembly further comprising a base coupled to the ring or coupling feature, the base having a locking channel that removably locks to said pin or pins. In certain examples, a lifting bracket is coupled to the uninterrupted cap. In certain examples, the cap further has an inner surface, and the lifting bracket coupled to the inner surface of said uninterrupted cap. In certain examples, a plurality of lifting assemblies are provided. In certain examples, a chassis is coupled to the antenna and the lifting bracket to couple the antenna to the lifting bracket.

In other aspects of the disclosure, an antenna assembly has a radome having an outer surface and an uninterrupted cap, and a lifting assembly or multiple lifting assemblies attached to the outer surface of the radome. In certain examples, the uninterrupted cap forms an unbroken whole. In certain examples, the uninterrupted cap is continuous without any through-holes or other perturbances or features that extend through the cap or otherwise might allow fluid to pass through the cap into an interior of the main body. In certain examples, the lifting assembly includes a ring or coupling feature integrally formed with said radome. In certain examples, the lifting assembly includes a ring or coupling feature removably attached to the radome. In certain examples, a pin or pins coupled to or embedded partway through the radome, the lifting assembly further comprising a base coupled to the ring or coupling feature, the base having a locking channel that removably locks to the pin or pins. In certain examples, a lifting bracket is coupled to the uninterrupted cap. In certain examples, the uninterrupted cap further has an inner surface, said lifting bracket coupled to the inner surface of said uninterrupted cap. In certain examples, the lifting assembly comprises an eyelet.

In other aspects of the disclosure, an assembly for enclosing one or more antennas has an uninterrupted housing having an outer surface, and an eyelet, or plurality of eyelets or lifting assemblies attached to the outer surface of said uninterrupted housing. In certain examples, the housing has an open bottom. In certain examples, the housing has an interior, and an antenna received in the interior of said housing. In certain examples, the lifting assembly includes a ring or coupling feature integrally formed with said radome. In certain examples, the lifting assembly includes a ring or coupling feature removably attached to said radome. In certain examples, a pin or pins are coupled to or embedded partway through the housing, said lifting assembly further comprising a base coupled to the ring or coupling feature, said base having a locking channel that removably locks to said pin or pins. In certain examples, the lifting assembly comprises an eyelet.

One object of this disclosure is to provide an enclosure which prevents penetration into the enclosure that would otherwise create environmental ingress points during installation. Another objective of the disclosure is to create an enclosure with an integrated lifting point to provide a means of lifting an antenna or plurality of antennas for the wireless communication industry without creating environmental ingress points.

The disclosure addresses lifting and placement of antenna nodes by incorporating an integrated lifting point, or multiple lifting points, that generally orient the antenna into a position for final use. The lifting mechanism does not require any ingress to the enclosure and the lifting mechanism can be removed to meet requirements that vary by region such as, but not limited to, zoning. In other iterations, the lifting mechanism is permanently fixed to the enclosure (cap, shroud, or radome) through the use of insert-molding, overmolding, welding, bonding, fastening or other joining methods.

One embodiment has an integrated lifting point, generally located (but not limited to) towards the top of the structure that does not penetrate the enclosure. The integrated lifting point is an eyelet-like feature that can be used to lift the antenna (or shroud or enclosure) during deployment and allows for the efficient installation of antennas. This embodiment also allows for the removal of the eyelet-like feature after installation, improving the aesthetics of the completed installation and reducing the overall height. There is also a fail-safe locking mechanism to prevent the accidental removal of the eyelet-like feature while installed or during use. There is no environmental ingress into the enclosure with or without the eyelet-like feature or failsafe locking mechanism.

This summary is not intended to identify all essential features of the claimed subject matter, nor is it intended for use in determining the scope of the claimed subject matter. It is to be understood that both the foregoing general description and the following detailed description are exemplary and are intended to provide an overview or framework to understand the nature and character of the disclosure.

BRIEF DESCRIPTION OF FIGURES

The accompanying drawings are incorporated in and constitute a part of this specification. It is to be understood that the drawings illustrate only some examples of the disclosure and other examples or combinations of various examples that are not specifically illustrated in the figures may still fall within the scope of this disclosure. Examples will now be described with additional detail through the use of the drawings, in which:

FIGS. 1-3 show a prior art enclosure;

FIG. 4 is a perspective view of an antenna assembly having an enclosure;

FIG. 7(*b*) is a top and side view of the eyelet being removed from the cap;

FIG. 7(*c*) is a further enlarged cross-sectional view of the cap features;

FIG. 8(*b*) is a perspective bottom view of the fail-safe mechanism;

FIG. 11(*b*) is a side view of the antenna assembly installed in place; and

DETAILED DESCRIPTION

An antenna assembly has a radome configured to receive an antenna, an uninterrupted cap attached to said radome, said uninterrupted cap having an outer surface, and a lifting assembly or multiple lifting assemblies attached at the outer surface of said cap. In another aspect of the disclosure, an antenna assembly has a radome with an outer surface and an uninterrupted cap, and a lifting assembly or multiple lifting assemblies attached to the outer surface of said radome. In another aspect of the disclosure, an assembly for enclosing one or more antennas has an uninterrupted housing having an outer surface, and an eyelet, or plurality of eyelets or lifting assemblies attached to the outer surface of said uninterrupted housing.

Figure 5:
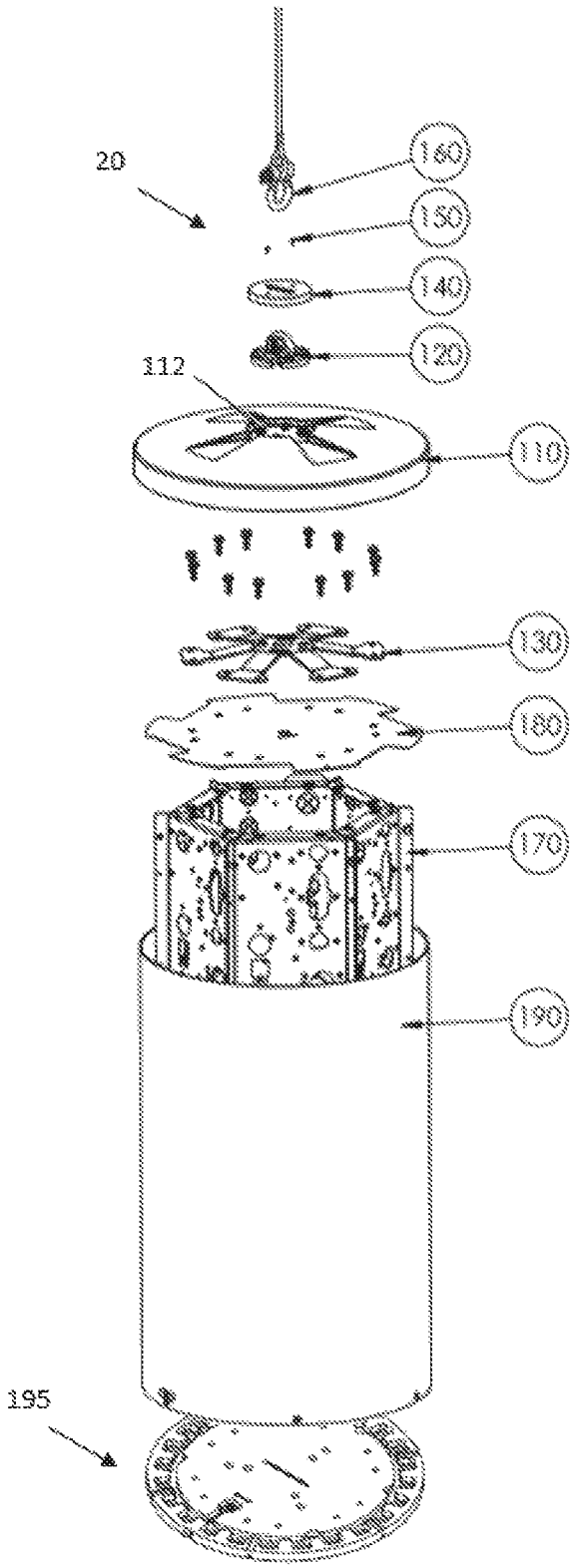
FIG. 5 is an exploded view of the antenna assembly.

FIGS. 4-10 show in one non-limiting illustrative example embodiment of the disclosure, a multi-node small cell antenna assembly 10. Turning to FIGS. 4-5, the antenna assembly 10 generally includes a housing or enclosure 100 and one or more antenna arrays 170 received in the enclosure 100.

Figure 12:
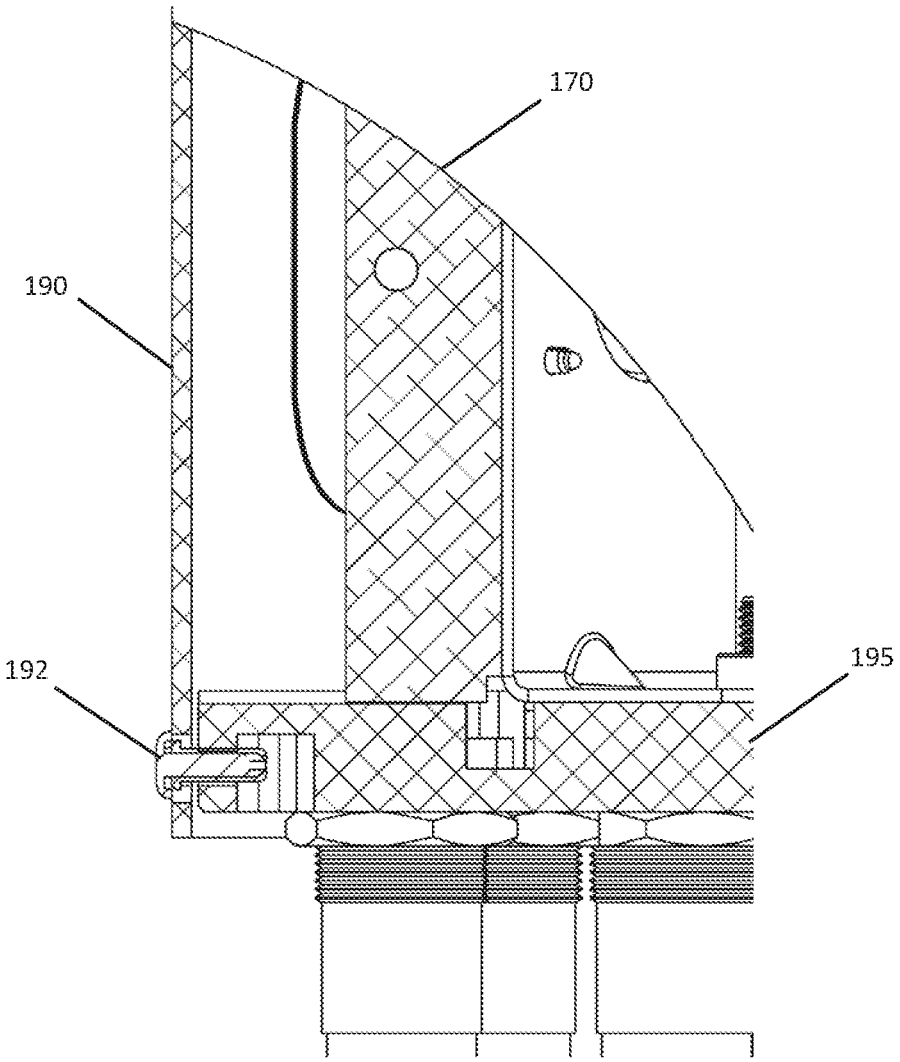
FIG. 12 is a partial cross-sectional side view of the base plate connected to the radome.

The enclosure 100 includes a radome 190, a top cap or cover 110, a base plate 195, and a lifting assembly 20. The radome 190 of the enclosure 100 is a hollow structure such as a cylindrical tube that has an interior portion and an exterior portion The radome 190 can have an open top and/or an open bottom. The cap 110 is matingly engaged at the open top of the radome 190 to seal closed the open top of the radome 190 in a liquid-tight manner. The cap 110 and the radome 190 are sealed using an adhesive to be water tight and permanently joined together. The radome 190 is also connected to the base plate 195 using rivets 192, as shown in FIG. 12. The radome 190, cap 110, and base plate 195 form the enclosure 100. The radome 190 and the cap 110 form a fluid-tight connection, though the base plate 195 and radome 190 need not form a fluid-tight connection. The antenna arrays 170 are received in the interior portion of the radome 190.

Figure 7A:
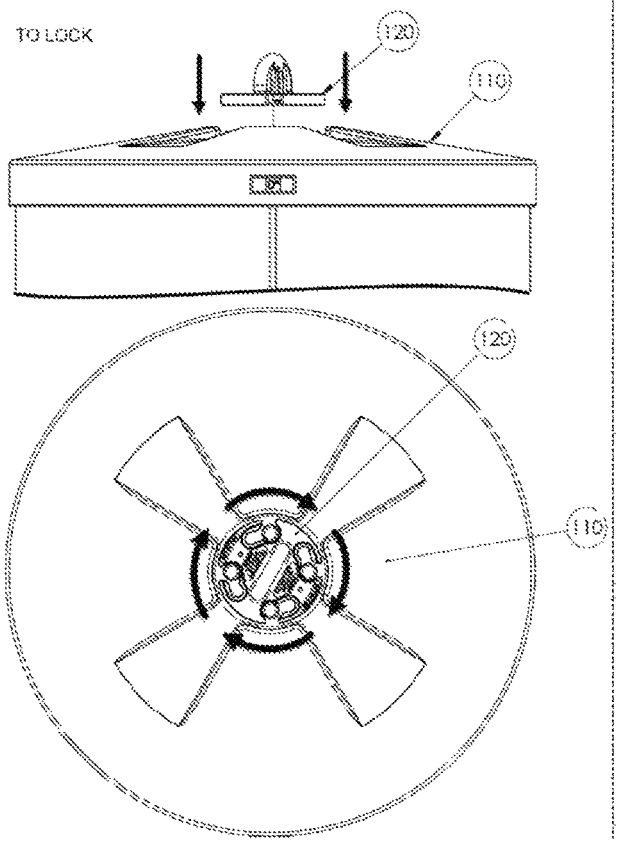
FIG. 7(*a*) is a side and top view of the eyelet being locked to the cap.
Figure 7B:
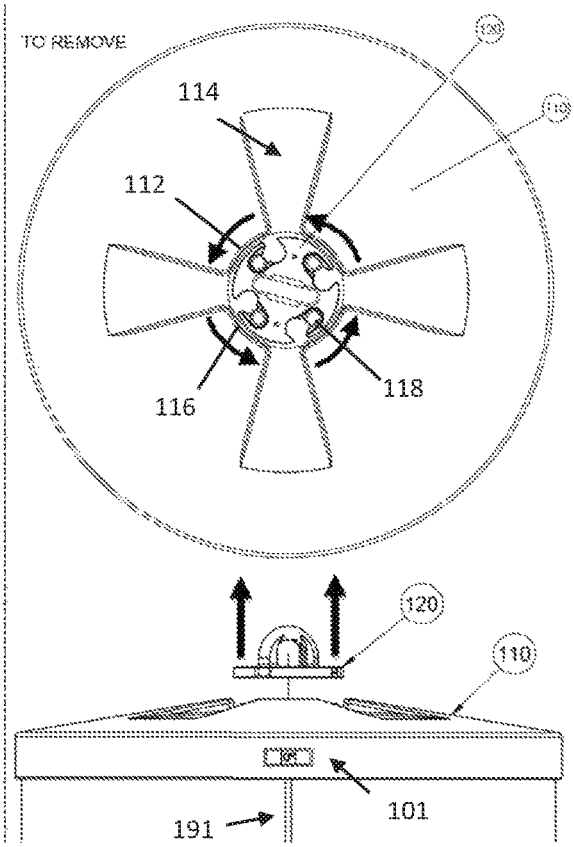
Figure 7C:
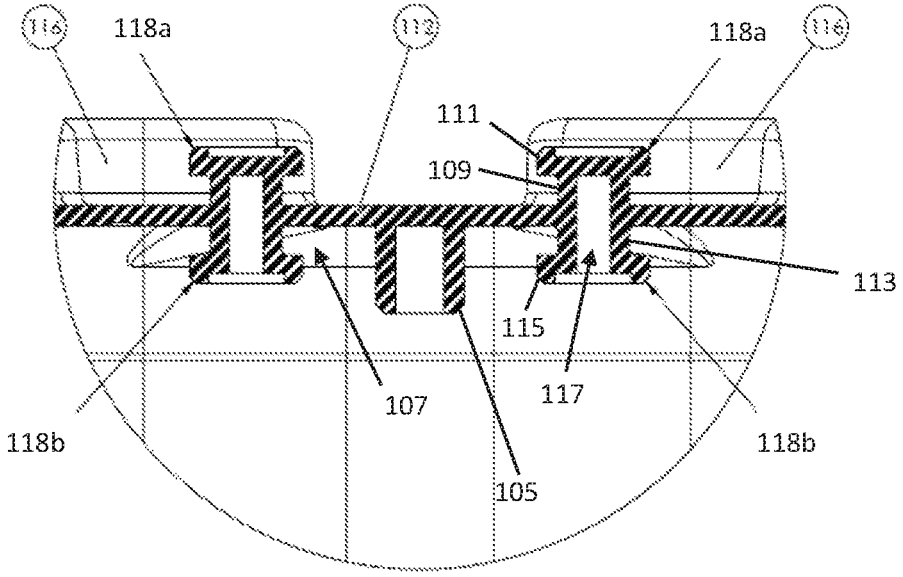

As best shown in FIGS. 7(*a*), 7(*b*), 7(*c*), the cap 110 can be a single unitary molded piece that has at least a partially beveled or sloped top surface that is taller in the center and shorter at the outer perimeter. The cap 110 includes a central depressed region forming a support base 112 with a surrounding wall 116 that extend up from the depressed support base 112. One or more channels 114 are formed in the top surface of the cap 110. The channels 114 expand away and outward from the support base 112 at the center of the cap 110 in an outward expanding pattern. The channels 114 are angled downward from the center support base 112 to operate as drains that divert liquid away from the center support base 112 to dispense off the cap 110. The channels 114 extend through the surrounding wall 116 and at least partially outward from the center support base 112 and about midway on the cap 110.

As best shown in FIG. 7(*c*), one or more pins or projections 118 are positioned in the cap 110 at the support base 112. The pins 118 are integrally formed during the molding process of the cap 100 and extend only partway through the cap 110 so they are coupled to and/or embedded in the cap 110.

As further illustrated in FIG. 7(*c*), one or more external pins 118*a* are formed at the external side of the cap 110, and one or more internal pins 118*b* are formed at the internal side of the cap 110. The external pins 118*a* are aligned with the internal pins 118*b*. The external pins 118*a* are formed by an external narrow neck 109 and an external widened head 111 at the distal end of the neck 109. The neck 109 can be formed by a wall that extends through the bottom of the support base 112. At the inside of the cap 110, the wall can form an internal neck 113. An internal widened head 115 is formed at the distal end of the internal neck 113 to form the internal pins 118*b*.

The walls of the necks 109, 113 create an internal bore 117 that extends through the internal head 115 and from one side of the cap 110 at the support base 112 to the other side of the cap 110. By having the bore 117 extend into the external neck 109, the bore 117 is extended and the internal neck 113 is reduced in length. However, the bore 117 can be formed so that it does not pass from the internal side to the external side of the support base 112, and is closed off at the support base 112. The underside 107 of the drain relief channel 114 can be straight (vertical) or optionally, for example, be angled inward to facilitate release from the mold. An alignment pin 105 extends downward from the inside surface of the cap 110 to guide/center the cap 110 onto the lifting bracket 130. The lifting bracket 130 can have a mating alignment pin or the like.

It is noted that the external head 111 is complete, to close the bore 117 at the external side of the support base 112, so that liquid cannot pass from the external side of the cap 110 to the internal side of the cap 110 via the bore 117 or pins 118. Thus, the cap 110 is a single unitary integral member that is "uninterrupted" in that it forms an unbroken whole or is continuous without any through-holes or other perturbances or features that extend completely through the cap 110 or otherwise might allow fluid to pass through the cap into the interior of the enclosure 100. Thus, the cap 110 is fluid-impermeable since fluid cannot penetrate or pass through the cap 110.

The base plate 195 can form a support for the antenna arrays 170. In one embodiment, as shown in FIG. 12, the antenna chassis 170 can be coupled (physically and/or electronically) to the base plate 195. The base plate 195 is coupled to the radome 190 at the bottom end of the radome 190. For example, through-holes can be made in the main body 190 that align with openings in the outer periphery of the bottom plate 195. Fasteners 192, such as screws or rivets, can pass through the through-holes in the radome 190 and into the base plate 195 to fasten the bottom plate 195 to the radome 190.

The base plate 195 need not be liquid tight. The rivets 192 that pass through the radome 190 into the base plate 195 do not penetrate the interior of the enclosure because the pockets that accept the rivets in the base plate are blindly cut from the bottom of the plate. This prevents water from getting in the side and continues off the drip edge or out the blind pocket. The base plate has drain holes to allow condensation to escape. The rivets 192 also prevent rotation of the enclosure 100, which keeps the interior pins 118*b* engaged to the lifting bracket 130.

As further shown, one or more electrical connections, such as pins, can extend through the base plate 195 and outward from the bottom surface of the base plate 195 to create the external connections required for the antenna installation.

Figure 6:
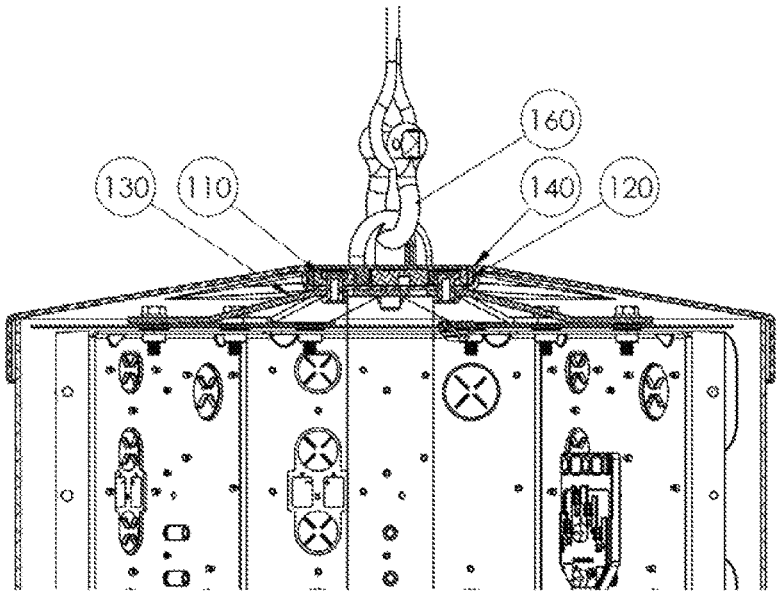
FIG. 6 is an enlarged cross-sectional side view of the top end of the antenna assembly.
Figure 8A:
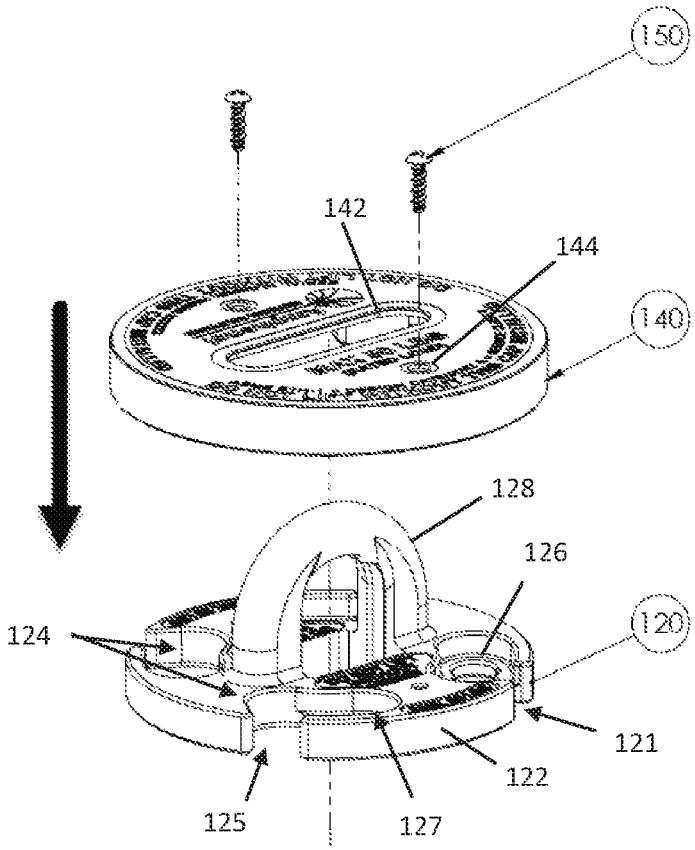
FIG. 8(*a*) is an exploded perspective view of the eyelet and fail-safe mechanism.
Figure 8B:
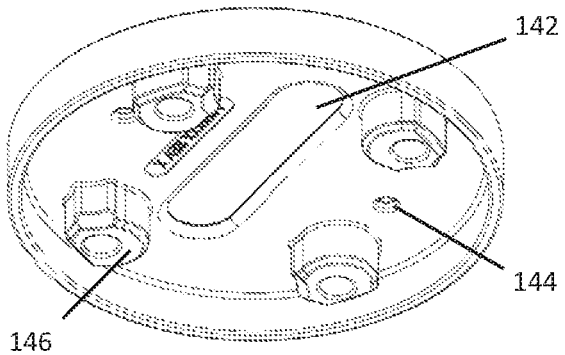

The lifting assembly 20 is best shown in FIGS. 5, 6, 8. The lifting assembly 20 includes a fastening mechanism such as an eyelet 120, and a fail-safe mechanism 140. The eyelet 120 is received in the center depressed support base 112 and attaches to the top outer surface of the top cap 110. In other embodiments, the fastening mechanism may instead attach to the radome 190 or any other part of the enclosure. The top cap 110 has an inner surface that connects with the top plate 180 and the multiple antenna arrays 170 via the lifting bracket 130 so that the lifting assembly 20 directly lifts the cap 110 and the antenna arrays 170 (via the lifting bracket 130 and top plate 180). The screws pass through the top plate 180 and the antenna chassis 170 at the same time and couple them together with the lift bracket 130. In addition, the radome 190 is adhered to the top cap 110 using a strong adhesive, though other connections can be provided such as a fastener or connector.

Thus, the antenna chassis 170 is not simply resting on the base plate 195 such that the base plate 195 lifts the antenna chassis 170 (which can be an alternative embodiment of the present disclosure). Instead, the antenna arrays 170 are lifted from the top by the lifting bracket 130 and top plate 180. Accordingly, when the user lifts the lifting assembly 20, the entire antenna assembly 10 is lifted, including the top cap 110, antenna arrays 170, and radome 190.

One or more locking mechanisms are provided to removably lock the eyelet 120 to the top surface of the cap 110. For example, in one embodiment of the disclosure, referring to FIG. 8(*a*), details of the eyelet 120 and fail-safe mechanism 140 are shown. The eyelet 120 includes a flat base 122 and an eyelet ring 128 that extends upward and outward from a top surface of the flat base 122. One or more locking channels 124 are formed in the flat base 122. The locking channels extend through the flat base 122. The locking channels 124 have an unlocking end 125 with an entry at the outer periphery of the flat base 122, and a locking end 127 opposite the unlocking end 125, and a guide portion connecting the unlocking end 125 and the locking end 127. A shelf 126 is formed at least at the locking end 127 of the locking channel 124 to define the locking end 127.

FIG. 6 shows a cross-sectional view of a fully assembled antenna 10 with integrated lifting mechanism. This figure shows how the eyelet 120 can attach to the top outer surface of the top cap 110. As noted, one or more pins or projections 118 extend upward from the top surface of the cap 110 at the support base 112 of the top cap 110. The pins 118 have a narrow neck 109 and a widened head 111. Each pin 118 is received in a respective one of the locking channels 124 to lockingly engage the pin neck 109 beneath the head 111 to lock the eyelet 120 to the top cap 110.

In operation, as shown in FIG. 7(*a*), the eyelet 120 is placed over the pins 118 at the center support base 112 between the walls 116, with the unlocking end 125 of the channels 121 aligned to the pins 118. The head and at least part of the neck of the pin 118 extend into the locking channel 121. In this unlocked position, the pin 118 is at the unlocked end of the channel 121. The head of the pin 118 is at a raised position in the locking channel 121.

The user then rotates the eyelet 120 in the direction of the arrows shown in FIG. 7(*a*) (clockwise in the embodiment shown), which moves the channels 121 with respect to the pins 118, and the head of the pins 118 slide over the shelf 126 in the locking channels 124. The pins 118 continue to be fully received at the locking end 127 of the channels 124, as shown in FIG. 7(*b*). The shelf 126 and widened pin head prevent the pins 118 from being pulled free of the channels 124, thereby removably locking the eyelet 120 to the cap 110. To remove the eyelet 120, the user rotates the eyelet 120 in the opposite direction, as shown by the arrows in FIG. 7(*b*) (counterclockwise in the embodiment shown), so that the pins 118 are no longer aligned with the shelf 126. The eyelet 120 can then be pulled off of the cap 110.

It is noted that the channels 124 form an opening at the sides of the base 122. However, in other embodiments, the entire channel 121 can be interior to the base 122 and need not form an opening at the side of the base 122. And the channel 124 need not extend through the entire width of the base 122, for example a snap fit can be formed that is closed. Alternatively, there could be no snap fit at all and engagement could rely solely on shelf 126 and locking mechanism 140.

Referring to FIGS. 8(*a*), (*b*), one embodiment of the fail-safe mechanism 140 (which may be optional) is a disc with a center slot 142 and through-holes 144. The slot 142 is aligned with and receives the eyelet ring 128, and the screws 150 pass through the through-holes 144 and into the openings in the base 122 of the eyelet 120 to attach the fail-safe mechanism 140 to the base 122 of the eyelet 120. The screws 150 do not penetrate the top cap 110.

As shown in FIG. 8(*b*), one or more locking features 146 are provided on the underside of the fail-safe mechanism 140. The locking features 146 are projections that extend outward orthogonal from the bottom surface of the fail-safe mechanism 140.

In operation, the eyelet 120 is attached to the pins 118 and rotated to a locked position. The fail-safe mechanism 140 is then placed over the eyelet 120 with the ring 128 received through the slot 142 of the fail-safe mechanism 140. That also aligns the locking features 146 with the unlocking end 125 of the channels 124. As the fail-safe mechanism 140 is further lowered onto the eyelet 120, the locking features 146 have a same shape as the unlocking end 125. Accordingly, the locking features 146 are captured by unlocking end 125, and do not provide the clearance necessary for the pins 118*a* of the top cap 110 to disengage from locking mechanism 120.

That is, the locking features 146 prevent the fail-safe mechanism 140 from moving co-planar to the planes of the fail-safe mechanism 140 and the base 122 of the eyelet 120. The fail-safe mechanism 140 can only move transverse to the base 122 (i.e., transverse to the planes of the fail-safe mechanism 140 and base 122), so the locking features 146 can move in and out of the channels 124. But the fail-safe mechanism 140 cannot be rotated with respect to the eyelet 120. The fail-safe mechanism 140 is then fastened to the base plate 122 of the eyelet 120 by the screws 150, via through holes 144 to further prevent inadvertent removal of the fail-safe mechanism 140 from the eyelet 120.

Thus, the fail-safe mechanism 140 prevents transverse motion of the eyelet 120 with respect to the top cap 110, which in turn prevents the eyelet 120 from inadvertently detaching from the cap 110. More specifically, since the locking features 146 fill the unlocking end 125 of the channel 124, the locking features 146 prevent the pins 118 from moving in the channels 124 from the locked position at the locked end 127 of the channels 124 to the unlocked position at the unlocked end 125 of the channels 124.

The entire assembly can be lifted by the shackle 160 (or, e.g., rope, tether or other suitable device), which can be removably attached to the hook or ring 128 of the eyelet 120. The fail-safe mechanism 140 is substantially co-planar with the base 122 of the eyelet 120 and orthogonal to the plane of the ring 128. And as best shown in FIG. 6, the top surface of the fail-safe mechanism 140 is substantially flush with the top surface of the cap 110.

Referring to FIGS. 5, 6, 7(*c*), 9, the lifting bracket 130 is attached to the inside surface of the cap 110. Referring to FIG. 7(*c*), posts 118*b* lock in vertical direction. The cap 110 is permanently bonded to the radome 190, and the rivets 192 prevent rotation. In one embodiment, the lifting bracket 130 can be attached to the cap 110 in a similar manner that the eyelet 120 attaches to the outer surface of the cap 110. That is, the lifting bracket 130 can have one or more grooves that lockingly and matingly engage one or more internal pins 118*b*, such as at the head 115, that extend outward from the inner surface of the cap 110 (e.g., see FIG. 10). The lifting bracket 130 has a center mount platform with the grooves, and arms that extend radially outward from the center mount platform.

The lifting bracket 130 is relatively flat and a widened head is located at the end of each arm with one or more through-holes. Screws pass through the through-holes and engage with openings in the top plate 180. The top plate 180, in turn, removably couples to the top end of the antenna chassis 170, such as the antenna substrate or platform. The top plate 180 can be a plate structure that attaches to the top of the antenna array 170 and can be substantially coplanar with the center planar axis of the cap 110 and the center planar axis of the lifting bracket 130. The lifting bracket 130 and top plate 180 extend substantially transverse across the radome 190 of the enclosure 100.

Accordingly, when the top cap 110 is lifted, the lifting bracket 130 directly lifts the top plate 180 and the antenna chassis 170. The cap 110 and the radome 190 are adhered together so that (once rivets are removed from the baseplate 195) the radome 190 is removed when 110 is removed. In another example embodiment, the bracket 130 can directly attach to the antenna array 170 without the use of a top plate 180. In addition, any suitable mechanism can be used to fasten (either removably or fixedly) the eyelet 120 to the cap 110 and the lifting bracket 130 to the cap 110, other than as described here.

In one embodiment, the pins that couple with the eyelet and the pins that couple with the lifting bracket, are molded features on the top cap 110, and do not have through-holes that extend all the way through the cap 110. That best prevents liquid from entering the interior space of the radome main body 190. Thus, the top cap 110 and radome 190 form an interior space that receives the lifting bracket 130, top plate 180, and antenna chassis 170, and protects the interior space from contamination and damage. Since the ends of the top cap 110 overlap and hang over the outer perimeter of the radome 190 and are properly sealed during assembly, liquid cannot enter the interior of the enclosure 100 or the radome 190.

Figure 9:
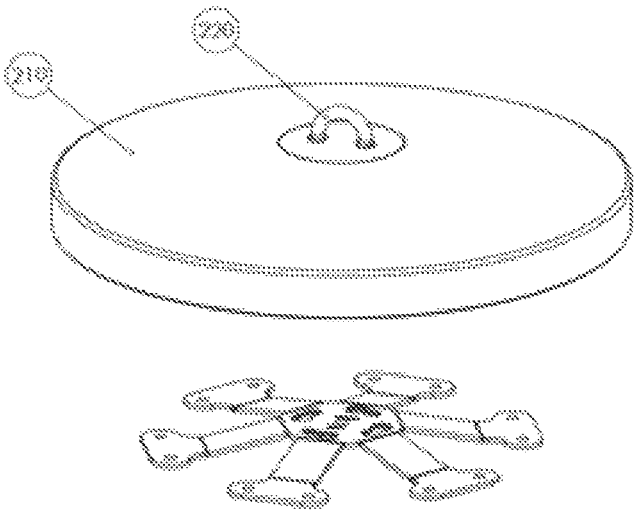
FIG. 9 is a perspective view of an insert-molded cap and bracket.
Figure 10:
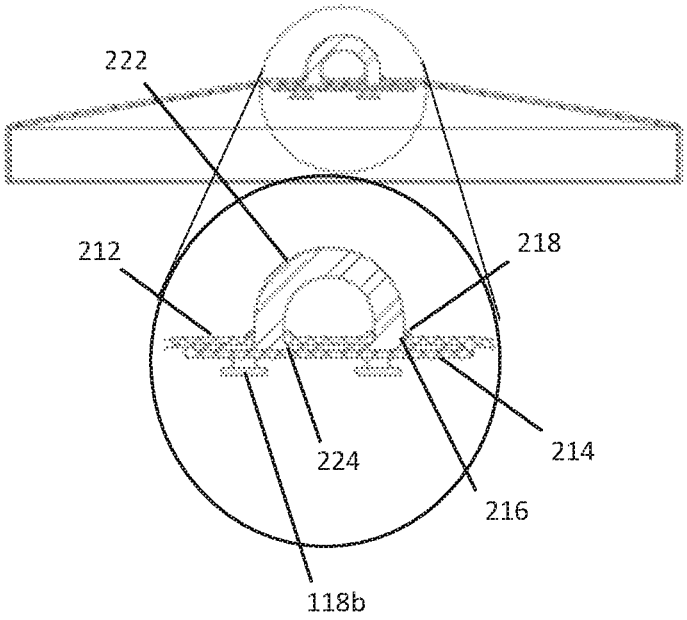
FIG. 10 is an enlarged cross-sectional view of the bracket and insert-molded eyelet and cap.

Turning to FIGS. 9, 10, another example embodiment of the disclosure is shown, where the top cap 210 has an integrally-formed eyelet 220. Thus, the eyelet 220 is insert molded as part of the top cap 210, such that they eyelet 220 is not removable from the cap. The eyelet 220 is insert molded into the top 210, so that the eyelet 220 is integral with the cap 210. Accordingly, pins are not needed to attach the eyelet 220 to the cap 210. The lifting bracket can also be integrally molded at the inside surface of the cap. In another embodiment, the lifting bracket and eyelet are not both integrally formed with the cap, but one of the lifting bracket or eyelet can be removably attached, such as shown in the embodiment of FIGS. 3-8. The top surface of the cap can have a flat center portion where the eyelet is located, and sloped to the sides of the flat center portion, to dispense fluid and ice from the top of the cap.

FIG. 10 shows the cross-sectional view of the insert molded top from FIG. 9. FIG. 10 shows pins at the inside of the cap to removably engage the lifting bracket, and the eyelet being integrally formed at the outside of the cap. As further illustrated, the eyelet has a hook or ring 222 and feet 224 at the base of the ring 222. The feet 224 can be thin flat portions that are wider than the ring 222 and extend outward from the base of the ring 222. The cap 210 has a top or outer layer 212 and a bottom or inner layer 214. The outer and inner layers 212, 214 can be separately slightly by a gap that receives the bottom portions of the ring 222 and the feet 224 through respective openings 216 in the top layer 212. The first layer 212 can form an upwardly turned lip 218 where the first layer 212 meets the ring 222, to further prevent liquid from entering the opening 216, or a seal can be placed about the opening 216. Thus, the widened feet 224 of the ring 222 cannot escape through the openings 216, thereby coupling the eyelet 220 to the cap 210. The first and second layers 212, 214 can be formed as integral pieces. Or, there can be a single layer with a gap formed internal to the layer to secure the feet 224 embedded within the layer of the cap.

Figure 11A:
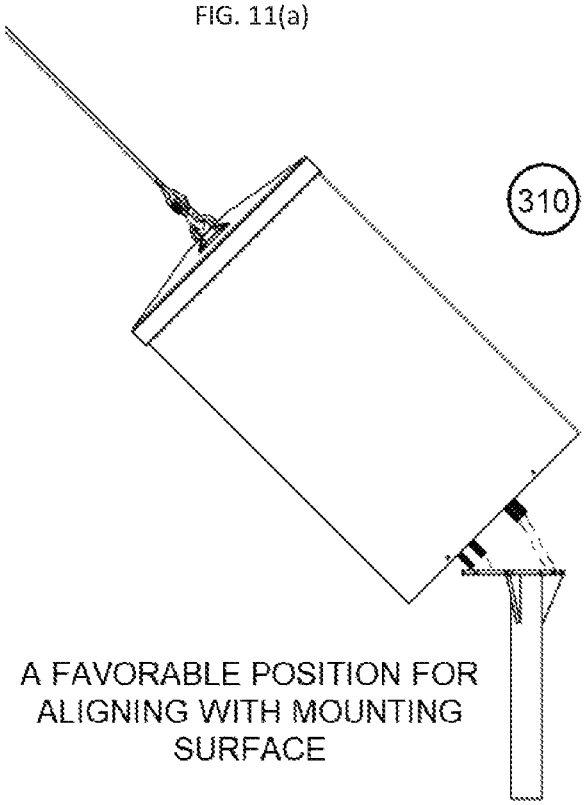
FIG. 11(*a*) is a side view showing installation of the antenna assembly.
Figure 11B:
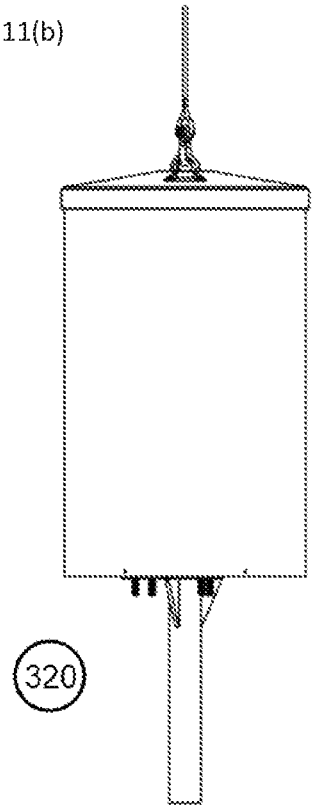

FIG. 11 shows a favorable orientation 310 and a final, assembled position of an antenna assembly 320, such as the antenna assemblies 10 shown in FIGS. 3-10. The shackle 160 can be used to position the antenna assembly 10 into position. The eyelet allows the antenna assembly 10 to be favorably positioned during installation to a mounting surface, such as on a tower or the like. Connectors or pins on the base plate 195 of the enclosure 100 can then be aligned with respective openings in the mounting surface and the antenna assembly 10 then moved to an upright final position, as shown.

Accordingly, as shown and described, one purpose of this disclosure is to provide a means of lifting which is integrated into the protective enclosure of an antenna assembly. For example, an enclosure (radome or shroud) can have an eyelet-like feature (or plurality of eyelet like features), either integrated into or removable from said enclosure, on an antenna or plurality of antennas, which can be utilized for lifting. The enclosure (radome or shroud) can be for, but not limited to aesthetical, mechanical, or electrical purposes. While the included figures show the current embodiment of the design, the concept is not meant to be solely constrained to the forms contained in the images.

The principle behind this disclosure has been stated to apply to an antenna, but the concept is not limited only to a single antenna or a plurality of antenna arrays. The reference of an antenna can also include a plurality of antennas encompassed within the enclosure. This can also be applied to a range of different types of antennas including small cell, DAS, base station antennas or any other device within the communications industry used to transmit or receive, existing as either passive or active variations, that employs a protective enclosure. Still further, the disclosed antenna assembly can be used for other components and need not be antennas or antenna arrays.

An antenna needs to be separated from its environment for many reasons including but not limited to, aesthetics, mechanical, and/or electrical reasons. The enclosure, which can also be referred to as a shroud or a radome and top cap assembly, can be a barrier that forms a protected interior space, shielding the internal space and components from contamination, environmental ingress, and physical damage. This can be accomplished through the use of a single-piece enclosure, or can consist of multiple pieces joined or sealed together. The enclosure/shroud/radome assembly can be attached to the antenna using a variety of methods including, but not limited to molded features, insert molded components, screws or other fasteners, welding or through the use of a sealing/bonding agent. Within the current disclosure, the enclosure is shown to be attached to a lifting bracket, but the enclosure can also attach directly to the chassis or any other structural member of the antenna.

The eyelet of the disclosure provides a lifting point (or multiple lifting points) integrated into the antenna assembly. The eyelet can be either removable through the use of molded features, screws or other temporary fastening methods, or it can be permanently fixed through methods such as but not limited to overmolding, welding or bonding. The disclosure depicts the eyelet as a round disk with a single eyelet, but other shapes or number of lifting points can be provided. The eyelet like feature may be a rigid member or non-rigid. The eyelet can be made of a strong hardened plastic, nylon, or other suitable material that is strong and lightweight. The cap can be made of PVC or other suitable material that is strong but lightweight. The removable eyelet (FIGS. 2-7) may couple to the enclosure using any, but not limited to the aforementioned joining embodiments. The fail-safe locking mechanism to prevent accidental removal of the eyelet-like feature. This is depicted as a separate entity that is attached with fasteners, but this could take also be integrated into the eyelet-like feature.

As further shown in FIG. 7(*b*), the radome 190 may be formed with a seam 191 during manufacture, if the radome is molded as a sheet and then welded together at the seam 191. An alignment indicator 101 can be provided at the side lip of the top cap 110. The alignment indicator 101 is a visual cue that enables the cap 110 to be properly aligned with the radome 190 so that the rivets 192 are properly aligned with the respective openings in the radome 190. In addition, the indicator 101 enables the user to easily identify the front of the antenna so that the antenna assembly 10 can be properly aligned when mounted in position, such as to the mounting surface (FIGS. 11(*a*), 11(*b*)).

The recessed lift hook provides reduced height and the removable eyelet 120 allows for additional height reduction. The channels 114 provide drain relief on the cap 110 to reduce the build-up of fluid and ice.

It will be apparent to those skilled in the art having the benefit of the teachings presented in the foregoing descriptions and the associated drawings that modifications, combinations, sub-combinations, and variations can be made without departing from the spirit or scope of this disclosure. Likewise, the various examples described may be used individually or in combination with other examples. Those skilled in the art will appreciate various combinations of examples not specifically described or illustrated herein that are still within the scope of this disclosure. In this respect, it is to be understood that the disclosure is not limited to the specific examples set forth and the examples of the disclosure are intended to be illustrative, not limiting.

Further, as used herein, it is intended that the term "eyelet" include all types of fasteners, whether closed, partially closed, or open, but generally have a shape (circular or not) that allows a hook or other object to grasp or coupled to it in a removable fashion. In addition, any suitable fastener can be utilized within the scope of the disclosure, such as a clasp, snap, or release mechanism, and it need not be an eyelet.

It is further noted that while the top cap 110 is shown and described as being a discrete component that is separate from the radome 190, the top cap 110 can be integrally formed with the radome 190 to be a single unitary piece.

Additionally, it is intended that any number of lifting eyelets may be integrally formed or removably mated with any part of a top cap, radome or other form of enclosure.

As used in this specification and the appended claims, the singular forms "a", "an" and "the" include plural referents, unless the context clearly dictates otherwise. Similarly, the adjective "another," when used to introduce an element, is intended to mean one or more elements. The terms "comprising," "including," "having" and similar terms are intended to be inclusive such that there may be additional elements other than the listed elements.

Additionally, where a method or process referred to or described above or a method claim below does not explicitly require an order to be followed by its steps or an order is otherwise not required based on the description or claim language, it is not intended that any particular order be inferred. Likewise, where a method claim below does not explicitly recite a step mentioned in the description above, it should not be assumed that the step is required by the claim.

It is noted that the description and claims may use geometric or relational terms, such as upright, top, bottom, curved, elongated, parallel, perpendicular, orthogonal, planar, coplanar, end, exterior, interior, outer, inner, perimeter, periphery, clockwise, and counterclockwise. These terms are not intended to limit the disclosure and, in general, are used for convenience to facilitate the description based on the examples shown in the figures. In addition, the geometric or relational terms may not be exact. For instance, walls or components may not be exactly coplanar, perpendicular or parallel to one another because of, for example, roughness of surfaces, tolerances allowed in manufacturing, etc., but may still be considered to be perpendicular or parallel.

The invention claimed is:

1. An antenna assembly, comprising:

a radome configured to receive an antenna:

an uninterrupted cap attached to said radome, said uninterrupted cap having an outer surface, wherein said uninterrupted cap is continuous without any through-holes or other perturbances or features that extend through the cap or otherwise might allow fluid to pass through the cap into an interior of the main body; and a lifting assembly attached at the outer surface of said cap.

2. The antenna assembly of claim 1, wherein said lifting assembly includes a ring or coupling feature integrally formed with said uninterrupted cap.

3. The antenna assembly of claim 1, further comprising a pin or pins coupled to or embedded partway through the uninterrupted cap, said lifting assembly further comprising a base coupled to the ring or coupling feature, said base having a locking channel that removably locks to said pin or pins.

4. The antenna assembly of claim 1, further comprising a lifting bracket coupled to said uninterrupted cap.

5. An antenna assembly, comprising:

a radome configured to receive an antenna;

an uninterrupted cap attached to said radome, said uninterrupted cap having an outer surface; and a lifting assembly attached at the outer surface of said cap, wherein said lifting assembly includes a ring or coupling feature removably attached to said uninterrupted cap.

6. The antenna assembly of claim 5, wherein said uninterrupted cap forms an unbroken whole.

7. An antenna assembly, comprising:

a radome configured to receive an antenna;

an uninterrupted cap attached to said radome, said uninterrupted cap having an outer surface and an inner surface;

a lifting assembly attached at the outer surface of said cap; and a lifting bracket coupled to said uninterrupted cap, said lifting bracket coupled to the inner surface of said uninterrupted cap.

8. The antenna assembly of claim 7, further comprising a plurality of lifting assemblies.

9. The antenna assembly of claim 7, further comprising a chassis coupled to said antenna and said lifting bracket to couple said antenna to said lifting bracket.

10. An antenna assembly, comprising a radome having an outer surface and an uninterrupted cap, and a lifting assembly or multiple lifting assemblies attached to the outer surface of said radome, wherein said uninterrupted cap is continuous without any through-holes or other perturbances or features that extend through the cap or otherwise might allow fluid to pass through the cap into an interior of the main body.

11. The antenna assembly of claim 10, wherein said uninterrupted cap forms an unbroken whole.

12. The antenna assembly of claim 10, wherein said lifting assembly includes a ring or coupling feature integrally formed with said radome.

13. The antenna assembly of claim 10, further comprising a lifting bracket coupled to said uninterrupted cap.

14. The antenna assembly of claim 10, said lifting assembly comprising an eyelet.

15. An antenna assembly, comprising a radome having an outer surface and an uninterrupted cap, and a lifting assembly or multiple lifting assemblies attached to the outer surface of said radome, wherein said lifting assembly includes a ring or coupling feature removably attached to said radome.

16. The antenna assembly of claim 15, further comprising a pin or pins coupled to or embedded partway through the radome, said lifting assembly further comprising a base coupled to the ring or coupling feature, said base having a locking channel that removably locks to said pin or pins.

17. An antenna assembly, comprising:

a radome having an outer surface and an uninterrupted cap, and a lifting assembly or multiple lifting assemblies attached to the outer surface of said radome, said uninterrupted cap further having an inner surface, said lifting bracket coupled to the inner surface of said uninterrupted cap.

18. An assembly for enclosing one or more antennas, comprising:

an uninterrupted housing having an outer surface, and an eyelet, or plurality of eyelets or lifting assembly attached to the outer surface of said uninterrupted housing, wherein said lifting assembly includes a ring or coupling feature removably attached to said radome.

19. The assembly of claim 18, said housing having an open bottom.

20. The assembly of claim 18, said housing having an interior, and further comprising an antenna received in the interior of said housing.

21. The antenna assembly of claim 18, wherein said lifting assembly includes a ring or coupling feature integrally formed with said radome.

22. The antenna assembly of claim 18, further comprising a pin or pins coupled to or embedded partway through the housing, said lifting assembly further comprising a base coupled to the ring or coupling feature, said base having a locking channel that removably locks to said pin or pins.

23. The antenna assembly of claim 18, said lifting assembly comprising an eyelet.

* * * * *